United States Patent [19]

Maus

[11] 4,050,364

[45] Sept. 27, 1977

[54] VENTILATING DEVICE

[75] Inventor: Julius Maus, Stuttgart, Germany

[73] Assignee: Gretsch-Unitas GmbH Baubeschlagfabrik, Germany

[21] Appl. No.: 657,220

[22] Filed: Feb. 11, 1976

[30] Foreign Application Priority Data

Feb. 12, 1975 Germany ..... 7504175[U]

[51] Int. Cl.[2] ..... F24F 7/00

[52] U.S. Cl. ..... 98/37; 98/39; 98/88 R; 98/108; 98/94 R; 181/224

[58] Field of Search ..... 98/37, 39, 88 L, 94 R, 98/99.6, 99.8, 107, 108, 110, 114, DIG. 10; 181/33 K, 33 GD, 33 GE, 33 GB

[56] References Cited

U.S. PATENT DOCUMENTS

| | | | |
|---|---|---|---|
| 1,562,061 | 11/1925 | Schneider | 98/DIG. 10 |
| 1,665,211 | 4/1928 | Kennedy | 181/33 GB |
| 1,975,316 | 10/1934 | Ferris | 98/37 |
| 2,125,669 | 8/1938 | Fisk | 181/33 GB |
| 2,216,420 | 10/1940 | Rose | 181/33 GB |
| 2,704,504 | 3/1955 | Wilkening | 181/33 GB |
| 2,726,518 | 12/1955 | Brugler | 98/94 AC |
| 2,992,701 | 7/1961 | White | 98/94 |
| 3,799,703 | 3/1974 | Paine et al. | 98/39 |

*Primary Examiner*—John J. Camby
*Assistant Examiner*—Henry C. Yuen
*Attorney, Agent, or Firm*—McGlew and Tuttle

[57] ABSTRACT

A ventilating device for mounting on a wall or support frame which has an air flow passage therethrough comprises a housing of generally rectangular or block shaped form. The housing has a back wall which is mounted on brackets secured to the mounting wall and which includes an air inlet aligned with the air passage defined through the mounting wall. An insulation layer is secured to the top and bottom walls of the housing and to the cover. When the cover is closed the cover layer insulation fits between the top and bottom layers and the three layers define a tortuous or meandering flow path for the air from the inlet to the outlet which is defined at the front end of the housing opposite to the rear wall. The outlet is closed by the cover which has an adjustable register and the apparatus advantageously includes a fan arranged to draw air in through the inlet and circulate it through the tortuous path between the insulations to the outlet for flow out through the register.

21 Claims, 4 Drawing Figures

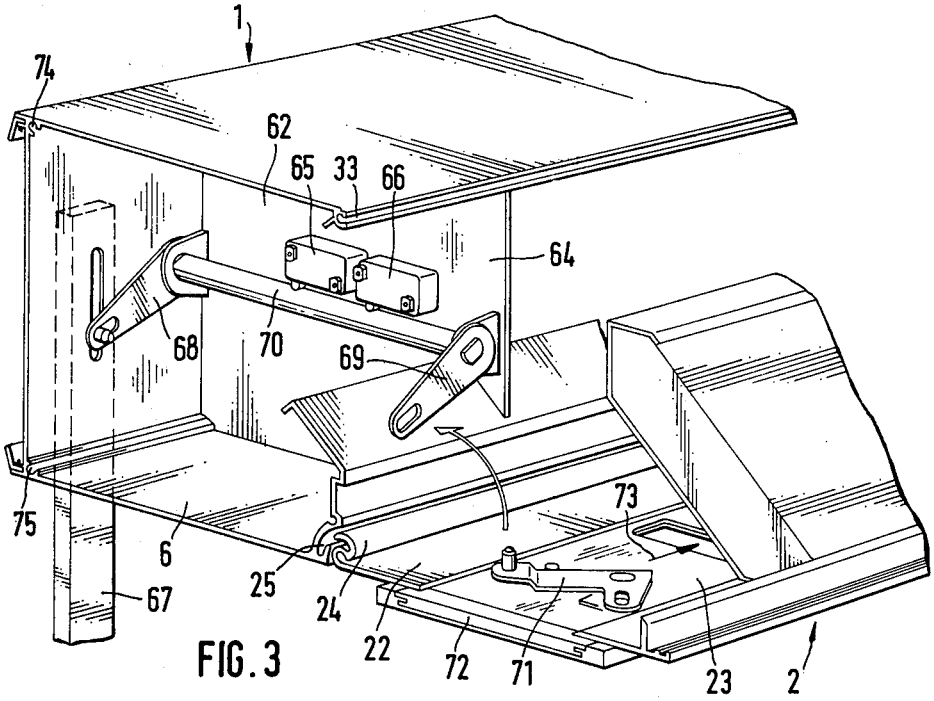
FIG. 3
FIG. 4
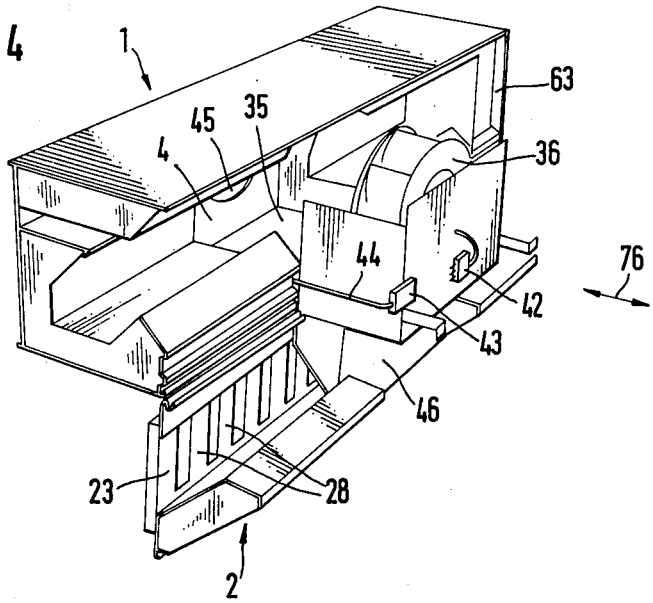

VENTILATING DEVICE

BACKGROUND OF THE INVENTION

1. Field of the Invention

This invention relates in general to the construction of ventilating devices and in particular to a new and useful ventilating device which may be mounted for example on the ventilating slot of a door or window frame or on a wall opening.

2. Description of the Prior Art

Ventilating devices are already known in various designs. They are known as ventilating systems operating permanently or operable intermittently, as needed. A drawback of the known constructions is that simultaneously with the air, noise also penetrates into the space to be ventilated. The same applies, of course, to the evacuation of air.

SUMMARY OF THE INVENTION

The present invention is directed to a ventilation device preventing, or at least substantially reducing, the penetration of outside noise into the space to be ventilated.

For this purpose, a ventilation device is provided which is designed to be used in connection with a door or window frame and which includes the box-like insulating housing having an elongated shape and which is secured to the inside of the upper crossbar of a blind frame. Consequently, both the air inlet and the air outlet are designed as a separate, longitudinally extending, elongated slot which may be subdivided into individual sectors. This applies analogously to the slot or opening in the frame, wall, or the like. Since the housing of the ventilation device is designed as an insulating housing, thus made of an insulating material or, at least, partly filled with an insulating material, an attenuation or absorption of the outside noise is obtained in the intended manner. Naturally, the longer the path of flow through the insulating housing, the greater is the effect. The path may be extended, for example, so that the air does not flow directly from the air inlet to the air outlet but along a particularly configurated path. At the same time, of course, the length of the path of flow and dimensioning of its cross section must be chosen so that the air exchange can take place without additional devices. Insofar as the requirements of the sound attenuation and the requirements of a satisfactory ventilation are contrary to each other a compromise is found complying with both requirements.

In accordance with a preferred embodiment of the invention, the insulating housing and cover comprise a box and a cover, both made of a compact material, which are coated, at least on their insides, with layers of an insulating material, particularly a cellular plastic or fiberglass matting, and the insulating layers are, preferably, coated at least unilaterally, with a covering foil. The box is made of a more compact and, therefore, less insulating material, such as a metal or plastic which adequately protect the insulating layers against mechanical damage.

In order to obtain an extension of the path of flow through the ventilation device, the insulating layers provided in the interior of the housing form a sinuous, meandering or zig-zagged flow channel. In any case, however, the general direction of flow of the air remains perpendicular to the door or window plane and, ordinarily, the ventilating effect ranges over the entire width of the door or window. In all of the variants of the embodiments, a uniform air passage, free of draft, is obtained.

According to a development of the invention, the cross sections of the insulating parts or elements forming the path of flow are of approximately angular and/or arcuate configuration, with the legs of the angle or arc of one part projecting between and being laterally spaced from the legs of the associated part, and the outer surfaces of each part or element are coverd partly by the housing walls of compact material and partly by an acoustically stiff covering layer. This covering layer should be as smooth as possible to prevent a deposition of dust and to reduce the flow resistance at these locations to a minimum. At their lateral ends, the two or the various insulating elements may, of course, be connected to each other, which also involves the possibility of integrating the different insulating elements in manufacture. As a rule, however, a separate manufacture of the insulating elements will probably be less expensive. This at least applies to smaller series. Actually, for reasons of manufacture and still other ones, for example, of simplifying the cleaning of the interior of a ventilation device, the invention is advantageously developed by providing that at least one of the parts of insulating layers is constituted of two elements of which one element is affixed to the hinged cover of the housing and the other element is affixed to the housing wall associated with the free end of the hinged cover. With the hinged cover closed, the two elements abut each other hermetically along a definite surface area thus forming one of the mentioned parts of the insulation, in particular that part having an angular cross section. If, on the contrary, the hinged cover is opened, the element affixed to the cover is also swung away while the element affixed to the housing wall remains in place.

According to a further development of the invention, the housing box is designed with a rectangular or square cross section and the slab-like element of the insulating layer affixed to the top wall of the housing is tapered in the shape of a wedge at its end associated with the hinged cover, and the bottom wall as well as the housing wall opposite to the hinged cover is coated with an insulating layer having an arcuate, i.e. approximately C- or U-shaped cross section. The slot-like cavity thereby formed between the two legs of the C- or U-shaped cross section extends approximately in a diagonal of the box and the insulating element affixed to the hinged cover, and with the cover closed it projects into this diagonal slot but is spaced away from all the surfaces defining this slot. In addition, the element supported by the cover applies tightly against the associated oblique end portion of the insulating layer affixed to the top wall of the housing.

According to still another development of the invention, the hinged cover is provided with a plurality of particularly rectangular ventilation slots separated by webs of approximately equal widths so that the slots may be entirely or partly closed by means of a similarly designed slide, to form a ventilation register. It is also possible and very advantageous to mount a register on the ventilation opening of the hinged cover designed as a longitudinal slot or, generally speaking, on the inlet or outlet slot of the ventilation device. The ventilation device cam be thus shut off. This may be required, for example, during the cold season or if, for some reasons, the outside air is to be prevented from passing into the space to be ventilated.

It may happen that the pressure difference between the outside and the interior does not insure a satisfactory air flow. In such a case, another embodiment of the invention is very useful according to which the insulating layers are interrupted, particularly, in the middle zone of the ventilation device, to form a cavity in which a fan, preferably an electric one, particularly a radial blower, is accommodated. The fan may be operated permanently or only intermittently.

Accordingly it is an object of the invention to provide an improved ventilating device which includes a housing which is adapted to be mounted in association with a wall having an air passage therethrough which has a rear wall which is adapted to be fastened to the associated wall and top and bottom walls extending outwardly from the rear wall and closed at their outer ends by a cover and wherein the cover carries an insulation piece which is disposed in respect to an insulation layer carried by the top wall and the bottom wall so as to define an elongated or tortuous flow path from an inlet at the rear wall to an outlet at the front wall which is closed by the cover and which is openable by a register in the cover.

A further object of the invention is to provide a ventilating device which includes an elongated air flow passage which is lined with insulation and which is advantageously defined by insulation layers carried by portions of the housing and by a cover member which is pivoted to the housing and which also provides a seal between the cover and the housing when the cover is in a closed position.

A further object of the invention is to provide a ventilating device which is simple in design, rugged in construction and economical to manufacture.

For an understanding of the principles of the invention, reference is made to the following description of typical embodiments thereof as illustrated in the accompanying drawings.

BRIEF DESCRIPTION OF THE DRAWINGS

In the Drawings:

FIG. 3 is a partial front end perspective view of the ventilating device housing shown in FIG. 1 with the insulation layers removed; and FIG. 4 is a view similar to FIG. 3 on a somewhat reduced scale and of another embodiment of the invention.

GENERAL DESCRIPTION OF THE PREFERRED EMBODIMENTS

Figure 1:
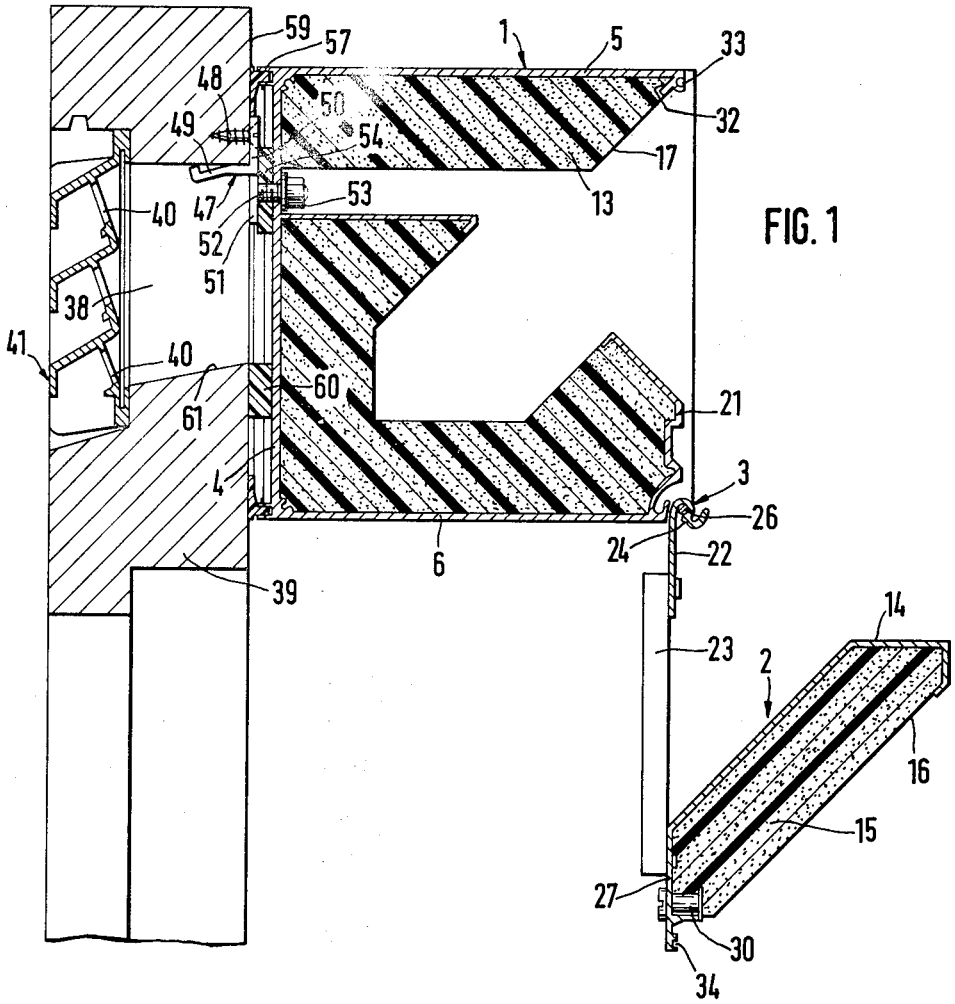
FIG. 1 is a cross-sectional view of a ventilating device mounted in a blind housing frame and constructed in accordance with the invention.
Figure 2:
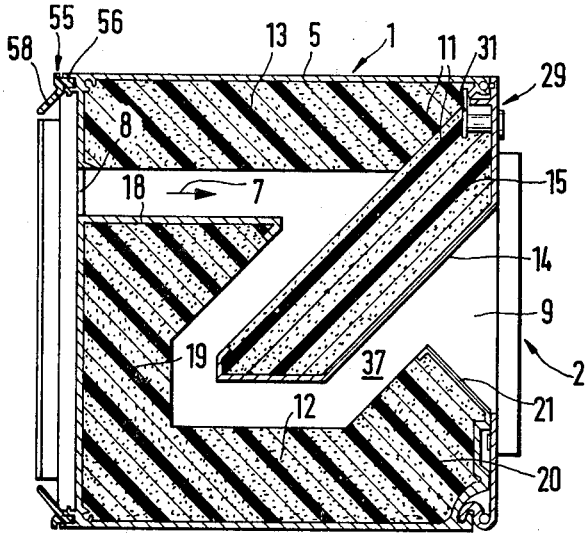
FIG. 2 is a view similar to FIG. 1 with the ventilating device shown in a closed position but with the housing frame not shown.

Referring to the drawings in particular, the invention embodied therein in FIGS. 1 to 3 comprises a ventilating device in the form of a box-like insulating housing generally designated 1 having a rectangular or square cross-section and which includes a cover generally designated 2 which is hinged to the housing front end on a pivot hinge 3. The housing 1 is substantially of U-shaped cross-section and it is provided with a top wall having a layer 13 of an insulation material secured thereto and a bottom wall 6 having a layer of insulation material 12 secured thereto. The back wall 4 advantageously forms a mounting wall.

In accordance with the invention the interior of the housing 1 defines an air flow path indicated by the arrow 7 which is elongated or tortuous but is generally in the axial flow direction indicated. The air flow extends from an air inlet 8 located in the rear wall 4 through an air outlet 9 located in the front wall which is closed by the hinged covers 2. Consequently the air must flow through the housing in the transverse direction. This also applies in respect to air flowing in an opposite direction opposite to the direction indicated by the arrow 7. The hinged cover is advantageously designed for both pivotal movement and for complete removal if desired.

In accordance with a feature of the invention the insulating layers 12 and 13 are preferably made of a cellular plastic that is a foam material. A fiberglass matting may also be used and preferably foam which is coated with a fiberglass finish or reinforced and which includes a cover foil covering the pores of the insulating material and thus protecting it against comtamination by dust. In accordance with a feature of the invention the cover carries an insulation layer 15 which extends obliquely downwardly from the cover and which forms a seal with the insulation layer 13 and also defines a zig-zag flow space for the air flow. The exit opening 9 is advantageously flared outwardly at that location. Of course other sections of flow path are possible or usable but anything providing a generally long or meander-like or wave-like flow passage is desirable. The insulating layers are provided in two parts namely the part 11 having an angular cross-section and the part 12 having an approximately C- or U-shaped cross-section. The part 11 comprises two separate insulating elements namely an insulating slab 13 affixed to the inside of the top wall 5 and the C-shaped part 12 which is affixed to the bottom wall 6 and possibly a part of the back wall 4. In addition an obliquely extending element or insulating layer 15 is secured to the cover 2 in a manner such that when the cover 2 is closed a surface 16 of insulating element 15 tightly applies against the oblique surface 17 of the insulating element 13. On each of the lateral or front ends of the two insulating parts 11 and 12 an insulating cover plate 14 is provided which extends parallel to the plane of the drawing. Such covers are advantageously integrated with the insulating layers or they may be cemented thereto. Each of the insulating elements 12, 13 and 15 are advantageously provided with an acoustically stiff cover layer. This layer is formed for the most part by the compact walls of the housing that is by the top wall 5, the bottom wall 6 and the back wall 4 as well as by the compact wall 14 of the cover. In addition the end surface of the C-shaped leg 19 of the insulating element 12 facing the underside of the insulating slab 13 is coated with an acoustically stiff plate 18 which is bent inwardly at its end and thus is conformable to the cross-section of the insulating material at this location. Leg portion 20 is also coated at its end with an acoustically stiff wall plate 21 which has the shape clearly indicated in FIG. 1. Plate 18 and plate 21 may be integrated into a single continuous extruded material plate if desired.

In accordance with another feature of the invention the cover 2 is hinged to the insulated housing 1 as shown in particular in FIG. 3. The cover 2 includes an end plate 22 which is connected to a cover wall portion 14 around the ventilation layer 15 which includes a ventilation register 23. The upper end portion of the sheet 22 is provided with an extension 24 of S-shaped cross-section. The free end of the S-shaped end portion 24 engages into an arcuate groove 25 formed at the free end of the bottom 6. When the cover is in a fully opened position for example as indicated in FIG. 1 extending downwardly 90° from the horizontal the extension 24 may be withdrawn from the groove 25 and the cover completely removed. Alternatively the cover and housing may be interconnected to each other by means of a bearing rod extending perpendicular to the drawing plane or by means of two bearing pins 26 as shown provided at each end of the housing. The ventilation register 23 of the embodiment of FIGS. 1 to 3 may be an integral part of the hinged cover 2 as shown in FIG. 3. In such a case the compact part 22 of the cover and strip 27 of the wall 14 are connected to each other by webs 28 not shown in FIG. 3 but identical to that as shown in FIG. 4. The parts in FIGS. 3 and 4 have been shown with identical numerals in view of their substantially identical operational features and FIG. 4 differs from the embodiment of FIGS. 1 to 3 by a design in which there is a cavity 35 for a ventilator fan 36 so that the insulation layers 12 and 13 have a central cutout or separation to accommodate the fan 36.

The hinged cover 2 is held in a closed position by means of a plurality of laterally spaced quick lock closures generally designated 29 as shown in FIG. 2. Each closure 29 comprises a stud 30 which is designed as a screw thread and which is mounted for rotation on the outside of the cover strip 27. and which carries on its inside an eccentric 31 which engages behind a ledge 32 which is formed at the free end of the top wall 5 of the housing. The ledge 32 extends in the direction of the oblique surface 17 of the insulating element 13. The labyrinth packing is also provided at this location which is formed as an extension 33 of the wall 5 and has a C-shaped cross-section. In addition an extension 34 having an approximately U-shaped cross-section is provided at the end of the strip 27.

In the embodiment of FIG. 4 the insulating layers are interrupted particularly in the middle zone in order to form a cavity 35 for an electric fan 36 and in other respects the embodiment is the same as FIGS. 1 to 3. The fan 36 is introduced into or removed from the cavity 35 in the direction shown by the double arrow 76. The fan 36 is a radial blower which provides a flow through ventilation channel 37 of the device and also through a passage for example a longitudinal slot 38 of a blind frame or wall structure 39 and slot 40 of a louver 41. An interruption of the insulation layers is provided only in cases where a built-in fan is employed.

The radial blower fan 36 is connected through a plug 42 and a plug 43 to an electric line 44 which leads to a power supply line so that it may be easily connected and disconnected for installation and removal purposes. In the mounted state the fan 36 is retained in the housing by means of at least one screw. The fan may be of a suction or a pressure type. At a location associated with the fan the back wall 4 of the housing is provided with an air passage opening 45 which is dimensioned in accordance with the capacity of the fan. In this construction an additional insulating plate 46 is provided between the fan 36 and the hinged cover 2.

Mounting means are provided for mounting the ventilation device on a wall structure such as the frame 39 which has the air passage therethrough. The mounting means comprises two suspension brackets 47 which are laterally spaced apart on the back wall 4. The device is mounted so that first suspension brackets 47 are screwed into the blind frame 39 by screws 48 as indicated in FIG. 1. The cross-section of the suspension bracket is approximately T-shaped and there is a middle leg portion 49 forming a stop angle with an upwardly extending cross leg 50. A downwardly extending cross leg 51 carries a bolt 52 formed thereon or secured thereto and which penetrates the back wall of the housing at the respective location. At this location the air passage opening is always interrupted by a strip in which a bore is provided. A washer or locking washer is engaged over an inwardly projecting end of the bolt 52 and a nut 53 is threaded thereon. In order to damp the oscillations a sealing element 54 such as a gasket is inserted between each suspension bracket 47 in the back wall 4 of the housing. This kind of a mounting of the ventilating device may be used for any door or window of conventional construction.

The back wall 4 of the housing may be provided with a peripheral sealing frame 58 which is made of one piece. The frame may also comprise four separate profile strips 55 having the shape shown in FIG. 2 with a fixing leg 56 being secured in a slot 57 formed between the rear wall 4 and the top wall 4 and the rear wall and each side wall and bottom. In a mounted state the sealing strips 58 apply flatly against the surface 59 of the blind frame 39. Within the sealing frame 55 another sealing strip 60 is provided as shown in FIG. 1 and this strip 60 is flush with the lower surface 61 of the longitudinal side 38 of the blind frame. Instead of a sealing strip 60, a sealing cord material can be used. Such a cord material as well as a sealing strip 60 serves to adjust the device to the passage 38. This is needed particularly if the inventive ventilating device is mounted on an aluminum window in which case it is intended at the same time as a thermal insulation.

To form a space 62 for switch elements as shown in FIG. 3 there is a partition 64 at a location spaced at least from one of the front walls 63 of the housing. This space serves for example for accommodating switches 65 and 66 and similar devices such as capacitors, terminals, linkages and the like for switching the fan 36 on and off. The partition surface facing the middle zone of the device may be coated at least partly with an insulating material. Because of the partition 64 a space 62 for the switch elements is provided from that part of the ventilation device where the air flows through.

The ventilation register 23 may be actuated for example by means of a push bar 67 which can be moved upwardly and downwardly in the direction of the window frame. The push bar 67 is advantageously coupled particularly in an adjustable manner to a swing lever 68 which is connected to a swing lever 69 through a connecting shaft 70 in the space 62. The swing lever 69 is connected through a pin slot connection through an actuating lever 71 of the ventilating register 23. With such an arrangement upon moving the push bar 67 upwardly a slide of the register 23 (not shown) moves in the direction of the arrow 73 and thereby clears the ventilation apertures. The connecting shaft 70 may be used at the same time as a switching shaft for actuating switches 65 and 66. Then with the register open the blower is automatically switched on while a closing of the register results in a stopping of the fan 36. If the two switches are used the fan may be operated in two switching steps corresponding to two positions of the slider of the register for example. Instead of a push bar 67 a control handle mounted outside the register may be used for actuating the switching mechanism 68, 69 and 70.

The operation of the device is as follows:

When ventilation or air flow through the slot 40 of the louvre 41 is desired the cover 2 may be opened as shown in FIG. 1 to permit air flow through air inlet 8 and outlet 9 and into the space to be ventilated. The cover may be closed to seal off the connection to the outside and to insure a proper insulated closure. In the embodiment of FIG. 4 the ventilation can be forced by the operation of fan 36 and the air may be discharged through the register 23.

Advantageously the electric switching elements for fan 36 are provided on a plug in printed board assembly. In this manner the elements may be easily exchanged or removed for repair.

The two front side lateral walls 63 of the housing are removable. In particular a plug in or snap in connection with the compact part of the insulating housing 1 is provided. If the compact part is made for example of aluminum the front wall 63 may be fixed for example by means of a self-tapping screws which are screwed into the corresponding channels, bores or other recesses and cut themselves a fixing thread. In the indicated example the two inner channels 74 and 75 are formed on the housing for this purpose. The groove 25 and the groove extension 33 may be also used for this purpose.

While specific embodiments of the invention have been shown and described in detail to illustrate the application of the principles of th invention, it will be understood that the invention may be embodied otherwise without departing from such principles.

What is claimed is:

1. A ventilating device for mounting on a wall, support frame, which has an air flow passage therein, comprising a housing having a back wall adapted to be mounted on the wall having the air flow passage, said back wall having at least one inlet opening, a top and a bottom wall extending outwardly from the back wall adjacent the top and bottom thereof respectively, an outlet between said top and bottom walls at the opposite ends thereof to said rear wall, a cover hinged at at least one of said top and bottom walls and adapted to close the outlet, a top, bottom and a cover layer of insulating material secured respectively to said top wall, said bottom wall and said cover, a layer of insulation material on said cover sealing with a portion of the layer secured to one of said top and bottom walls, said layers of insulation on each of said top and bottom walls and said cover being spaced apart in areas to define a continuous meandering air flow passage from said inlet to said outlet, said insulating layer connected to said top wall comprising a substantially straight piece having an oblique edge adjacent said outlet, said insulating layer covering said bottom wall comprising a substantially C-shaped portion having spaced apart legs and having a top portion spaced from said layer of insulation material covering said top wall, said cover having an obliquely extending insulation portion having an area sealing with the oblique portion of said layer covering said top wall and having a portion extending between the legs of the C-shaped layer covering said bottom wall, the air flow passage including a straight passage defined between the top portion of said insulation covering said bottom and the insulation covering said top wall and a generally U-shaped flow passage between the insulation covering said cover and the insulation covering said bottom wall between the leg portions thereof.

2. A ventilation device according to claim 1, including a hinge connection between said cover and one of said top and bottom walls permitting removal of said cover, said insulation layers having a coating at least on the sides thereof bounding the flow passage with a layer of insulating material comprising a cellular plastic matting and a covering foil.

3. A ventilating device according to claim 1, including a fan in said housing for circulating air through said flow passage.

4. A ventilation device for mounting on a wall, comprising a wall having a flow passage therethrough, a ventilation housing having a rear wall, bracket means on said housing mounting said rear wall on said wall having an opening therethrough, said rear wall of said housing having an opening therethrough, said housing including generally horizontal vertically spaced top and bottom walls, a cover hinged to said bottom wall and having means for securing it in a closed position adjacent said top wall, said housing being lined with a thick insulation therein defining an air flow passage extending from the opening of said rear wall to said cover wall, the insulation walls bounding said passage being made of a sound insulation material and forming a smooth air flow wall passage, said cover having register means for the outflow of the air from the passage into the surrounding space, the insulation material in said housing including a bottom layer covering said bottom wall of substantially C-shaped configuration and including an upstanding portion overlying said rear wall of said housing terminating in a top substantially horizontal surface and an obliquely extending leg wall portion extending upwardly from the opposite end of the portion of insulation overlying said bottom wall toward said cover, said cover having an obliquely extending insulation extending in between the leg portion and the upstanding portion of said insulation and having a portion in sealing engagement with a top layer covering said top wall, said top layer being spaced from the top edge of said upstanding portion of insulation, said insulation layers defining a straight path inwardly from the inlet opening in said rear wall and obliquely downwardly and backwardly around said layer carried by said cover and upwardly and outwardly toward said cover between said insulation carried by said cover and obliquely extending portion of the layer carried on said bottom wall.

5. A ventilating device according to claim 4, wherein said cover is provided with a plurality of rectangular ventilating slots which are equally spaced along an area of said cover and form a ventilating register, and slide means for opening and closing said register.

6. A ventilating device according to claim 5, wherein said cover includes a longitudinal slot, said ventilating register being mounted to cover the slot.

7. A ventilating device according to claim 6, wherein said cover is hinged to said bottom wall, said hinge connection comprising means to permit disconnection of said cover from said housing.

8. A ventilating device according to claim 4, wherein said housing walls comprise an aluminum material.

9. A ventilating device according to claim 8, including a bearing bolt at each side of said housing, said cover being pivotable on said bearing bolts.

10. A ventilating device according to claim 9, including a rotatable cam member carried on said cover at the end thereof opposite to the hinge connection to said housing and being rotatable to engage with the top wall of said housing to lock said cover member in a closed position.

11. A ventilating device according to claim 4, wherein said insulating material is separated within said housing to define a fan cavity opening rearwardly of said housing, and a fan removably insertable into the cavity of said housing.

12. A ventilating device according to claim 11, wherein said fan is an electrically driven radial blower in an electric line mounted in said housing.

13. A ventilating device according to claim 11, including an insulating plate provided between said fan and said housing cover.

14. A ventilating device according to claim 13, including a gasket between said bracket and said back wall.

15. A ventilating device according to claim 14, including at least one further sealing strip located intermediate the height of said rear wall between said rear wall and the mounting wall.

16. A ventilating device according to claim 4, wherein said mounting means for mounting said rear wall on the wall having the opening therethrough comprises at least two laterally spaced suspension brackets having means for securing said brackets on said back wall and on the mounting wall, said brackets including a bolt member carried thereby engageable through a wall the back wall of said housing and anchored thereto by a threaded nut.

17. A ventilating device according to claim 4, wherein said rear wall includes a peripheral sealing made up of four individual strips running along respective side, top and bottom walls.

18. A ventilating device according to claim 4, including a cavity defined in said housing within said insulating material for switching elements, a partition extending from said rear wall rearwardly to a spaced location from said cover and switching elements mounted on said partition.

19. A ventilating device according to claim 18, wherein said actuating mechanism includes a rotatable shaft, at least one lever connected to one side of said shaft, a ventilation register carried on said cover, a second lever connected to said shaft and to said ventilation register, a push bar connected to the said first lever extending parallel to the plane of the ventilation register between said rear wall and the wall upon which said rear wall is mounted, said connecting shaft having a non-circular cross-section and switch means located at said non-circular cross-section being actuated by rotation of said shaft.

20. A ventilating device for mounting on a wall, support frame, which has an air flow passage therein, comprising a housing having a back wall adapted to be mounted on the wall having the air flow passage, said back wall having at least one inlet opening, a top and a bottom wall extending outwardly from the back wall adjacent the top and bottom thereof respectively, an outlet between said top and bottom walls at the opposite ends thereof to said rear wall, a cover hinged at at least one of said top and bottom walls and adapted to close the outlet, a top, bottom and a cover layer of insulating material secured respectively to said top wall, said bottom wall and said cover, a layer of insulation material on said cover sealing with a portion of the layer secured to one of said top and bottom walls, said layers of insulation on each of said top and bottom walls and said cover being spaced apart in areas to define a continuous meandering air flow passage from said inlet to said outlet, said cover including an end portion having an S-shaped configuration which is pivotally mounted on said bottom wall, said cover containing an insulation layer which extends obliquely inwardly from the cover from the end thereof opposite to the hinged connection, the layer of insulation on said cover extending into said housing between portions of the layer of insulation secured to said bottom.

21. A ventilating device for mounting on a wall, support frame, which has an air flow passage therein, comprising a housing having a back wall adapted to be mounted on the wall having the air flow passage, said back wall having at least one inlet opening, a top and a bottom wall extending outwardly from the back wall adjacent the top and bottom thereof respectively, an outlet between said top and bottom walls at the opposite ends thereof to said rear wall, a cover hinged at at least one of said top and bottom walls and adapted to close the outlet, a top, bottom and a cover layer of insulating material secured respectively to said top wall, said bottom wall and said cover, a layer of insulation material on said cover sealing with a portion of the layer secured to one of said top and bottom walls, said layers of insulation on each of said top and bottom walls and said cover being spaced apart in areas to define a continuous meandering air flow passage from said inlet to said outlet, said cover including an end portion which is pivotally mounted on said bottom wall, said cover containing an insulation layer which extends obliquely inwardly from the cover from the end thereof opposite to the hinged connection, the layer of insulation on said cover extending into said housing between portions of layer of insulation secured to said bottom.

* * * * *